US005697276A

United States Patent [19]

Nassau

[11] Patent Number: 5,697,276

[45] Date of Patent: Dec. 16, 1997

[54] FOOD SLICING GUIDE

[76] Inventor: Sherwood Nassau, 429 Timberidge Trail, Gates Mills, Ohio 44040

[21] Appl. No.: 685,911

[22] Filed: Jul. 22, 1996

[51] Int. Cl.[6] ..... B26D 7/01

[52] U.S. Cl. ..... 83/762; 83/451; 83/468.7; 83/932; 269/54.5; 269/291; 269/295; 269/306

[58] Field of Search ..... 83/451, 454, 466.1, 83/467.1, 468.5, 468.6, 468.7, 761, 762, 763, 764, 765, 870, 932; 269/54.5, 87.2, 290, 291, 292, 295, 303, 306; D7/673

[56] References Cited

U.S. PATENT DOCUMENTS

| | | | |
|---|---|---|---|
| D. 135,457 | 4/1943 | Generale | 269/291 X |
| D. 316,657 | 5/1991 | Mulherin | D7/673 |
| D. 362,374 | 9/1995 | Roach | D7/673 |
| D. 369,725 | 5/1996 | Lansdowne | D7/673 |
| 2,352,125 | 6/1944 | Sager | 83/762 |
| 2,362,737 | 11/1944 | Wood | 83/762 |
| 5,577,430 | 11/1996 | Gunderson et al. | 83/762 X |
| 5,626,067 | 5/1997 | Lothe | 83/451 X |

FOREIGN PATENT DOCUMENTS

| | | | |
|---|---|---|---|
| 193617 | 3/1923 | United Kingdom | 269/54.5 |
| 586931 | 4/1947 | United Kingdom | 269/291 |

*Primary Examiner*—Rinaldi I. Rada
*Assistant Examiner*—Clark F. Dexter

[57] ABSTRACT

A food slicing device that holds food, particularly bread, in place while slicing. The bottom of the bread loaf is pierced to hold the loaf in place while slicing. Adjustment plates provide for varying slice width, or duplicating a slice of standard thickness. Adjustment plates may be stored on the back of the slicer. Grooves guide the knife when cutting bread. Cutting channels insure a cut completely through the item being sliced. A removable insert allows the top of the cutting platform to be replaced when it becomes abraded or damaged. The device is easily made by the home craftsman or can be mass produced.

6 Claims, 10 Drawing Sheets

FOOD SLICING GUIDE

BACKGROUND

1. Field of Invention

The present invention relates in general to a positioning and holding device to be used in cutting, and in particular to a food positioning and holding device with a guide for a cutting tool, such as a knife.

2. Description of Prior Art

Cutting and slicing uniform sections of food, such as bread, is an art which few people master. Most people who slice food without the use of a guide produce severed sections of different thicknesses, with the sections themselves having a wavy and uneven thickness. Yet uniform food sections are pleasing to the eye, improve cooking, give the person slicing the food a sense of satisfaction, and help prevent food waste.

None of the manual devices currently available provides for a means to prevent the food from slipping when it is being sliced. This is a desirable feature because it insures slices are of uniform thickness, and makes cutting safer. With the addition of such a means to the device, the user will not have to hold the food being sliced.

In addition, a way to ensure that complete cuts are made without the need for excessive force or repeated sawing is desirable. This simplifies slicing and reduces wear and tear on the cutting base and the cutting tool. One disadvantage of devices that are currently available is that the cutting utensil would abrade or scar the cutting platform. Such abrasions reduce the attractiveness of the device, and make cleaning the device more difficult. These devices also have failed to prevent dulling of the cutting edge of the slicing utensil when it contacts the food platform. Dulling of the cutting edge degrades the effectiveness of the knife or cutting utensil, sometimes to the point where the user applies excessive force and endangers himself.

Furthermore, no device currently available provides for a removable base to facilitate cleaning and to allow an old base to be replaced with new one.

Finally, the devices currently available are usually complex and expensive to mass produce. Others are prone to breakage or malfunction because of mechanical complexity or bits of food jamming the indexing mechanism.

Accordingly, several objects and advantages of the present invention are:

(a) to provide a food slicer which can be easily produced by either mass production techniques or by simple hand tools;

(b) to provide a food slicer that allows for slices of different thicknesses;

(c) to provide a food slicer that allows for multiple slices of the same thickness;

(d) to provide a food slicer that prevents the food from slipping when being sliced;

(e) to provide a food slicer incorporating a means to insure the food is sliced completely through;

(f) to provide a food slicer which attenuates cutting tool erosion; and (g) to provide a food slicer with a replaceable cutting surface. Still further objects and advantages will become apparent from a consideration of the ensuing description and drawings.

SUMMARY OF THE INVENTION

An improved slicing device is provided to assist with the slicing of various items, including food and particularly a loaf of bread. The device consists of a cutting platform with integrated guides and food holder, adjustment plates, and a removable holder for protrusions. The device is preferably constructed from hardwood, such as ash, birch, cherry, or other suitable material, such as plastic. Because they are relatively soft, using wood or plastic for construction of the device attenuates erosion of cutting tool surfaces.

The top of the cutting platform uses protrusions to pierce through the bread and hold it in place while being sliced. In wooden platforms, protrusions may consist of small nails or wires extending completely through the platform, or through a separate removable protrusion holder. Plastic platforms may have the protrusions molded into them, or use a separate, removable holder with protrusions molded into it. Protrusions are positioned in a manner that avoids contact with the cutting tool.

Removable protrusion holders facilitate cleaning of the plate and cutting platform. When a removable protrusion holder becomes overly abraded or soiled, it may be disposed of and replaced with a new plate.

Cutting platforms with a removable protrusion holder have a groove to accept the protrusion plate. Groove depth and plate thickness are such that the protrusion holder top is flush or slightly above the cutting platform top.

The cutting platform is enclosed on both sides and one end. One purpose of the end enclosure is to position the bread. The end enclosure has a short rod or dowel extending from its backside; the rod is located on the end enclosure's centerline and toward its top. The rod on the backside of the end enclosure provides an easy way to store adjustment plates, however alternative storage methods, such as bins, may be used.

One or more adjustment plates are provided. Each plate has a hole at its top and on its centerline. When in use, the plates are placed between the object being sliced and the front side of the end enclosure.

When an adjustment plate or plates is placed on the front face of the end enclosure, it decreases the distance between the front face of the end enclosure and the cutting channel most proximal to it. This action decreases the thickness of the piece of bread being sliced.

The side enclosures each contain a cutting slot or slots to guide the cutting tool. The slots start at the top of the side enclosures and extend down to the top of the cutting platform.

A cutting channel extends across the planar base and removable protrusion holder. The channel aligns with the guide slot. The channel facilitates passing a cutting instrument through the bottom of the item being sliced.

If the top of the removable protrusion holder is above the planar base, the cutting channel in the planar base is not necessary and only extends across the removable protrusion holder. If the planar base also serves as a protrusion holder the cutting channel extends from one guide slot to another.

OBJECTS AND ADVANTAGES OF THE INVENTION

Therefore, the objects of the present invention are: to provide a device for a food slicing guide; to provide such a device which is self contained; to provide such a device having side enclosures with integrated guides providing a two point guide for controlling a slicing utensil relative to the food being sliced and, therefore, providing accurate control of the thickness and uniformity of each slice of the food; to provide such a device which guides the slicing utensil such that it travels substantially perpendicular to a food supporting platform of the device; to provide such a device wherein the food supporting platform provides a means to prevent the movement or slipping of the food being sliced; to provide such a device wherein the width of the food being sliced is adjustable and reproducible; to provide such a device wherein portions of the food holding platform that become abraded by use are replaceable; to provide such a device containing a means to store and use detachable components of said device; and to generally provide such a device which is relatively easy to use, simple to maintain, reliable in performance, inexpensive to manufacture, and which generally performs the requirements of its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
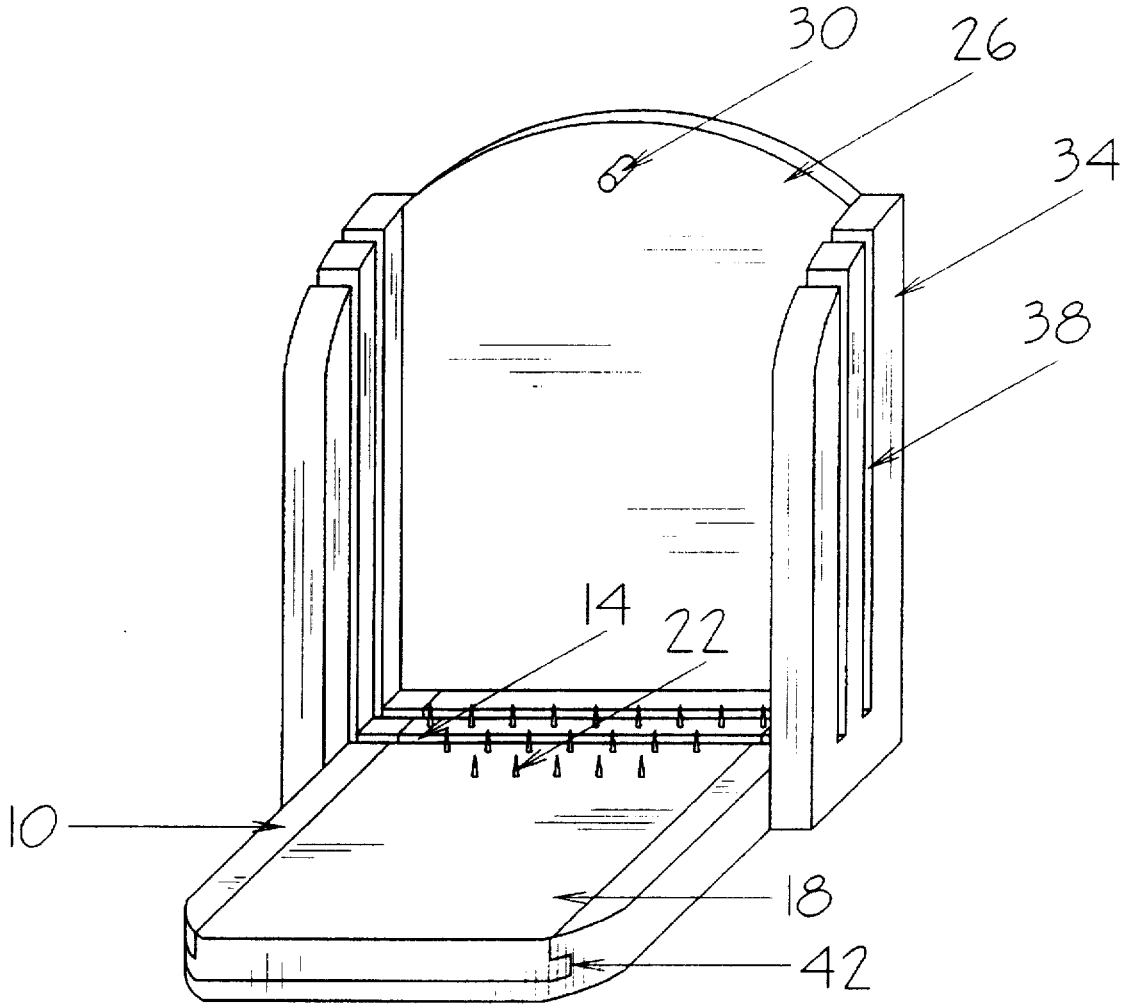
FIG. 1 is a perspective view of the food slicing guide of the present invention comprising a planar base, cutting channels in the planar base, removable protrusion holder, protrusions, end enclosure with rod, and side enclosure with grooves.
Figure 2:
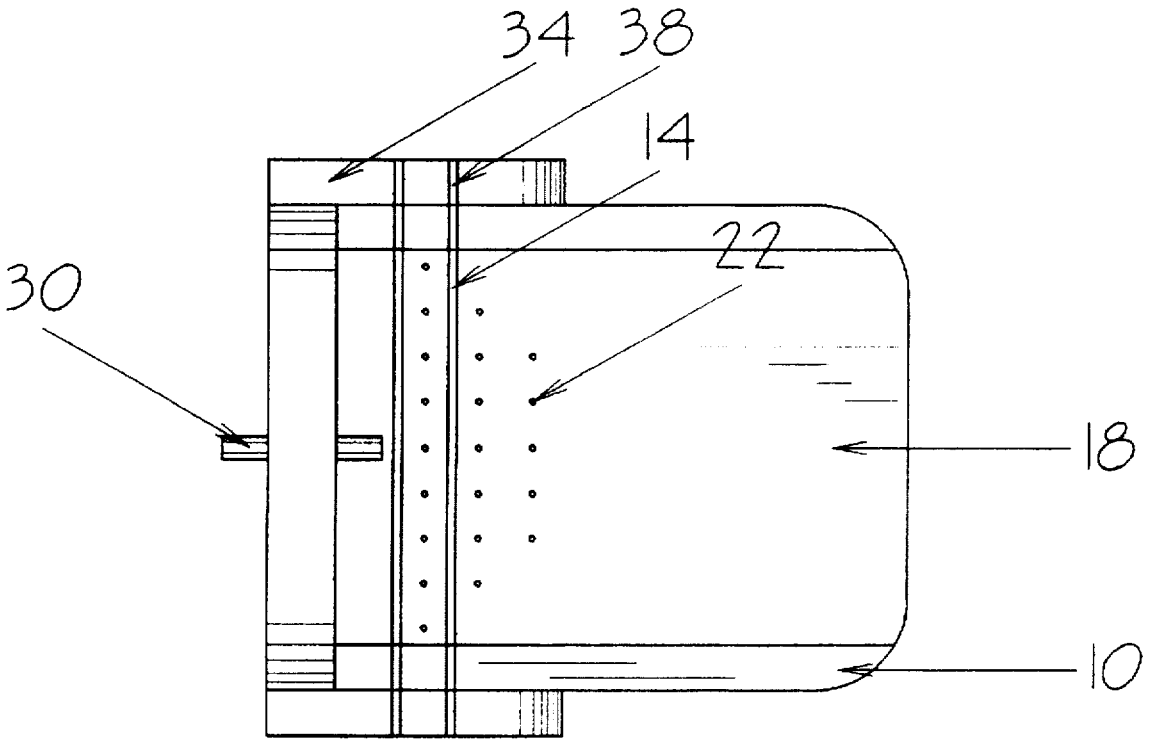
FIG. 2 is a top view of the food slicing guide showing the planar base, back face of the end enclosure with the rod extending therethrough, side enclosures, and cutting channels.
Figure 3:
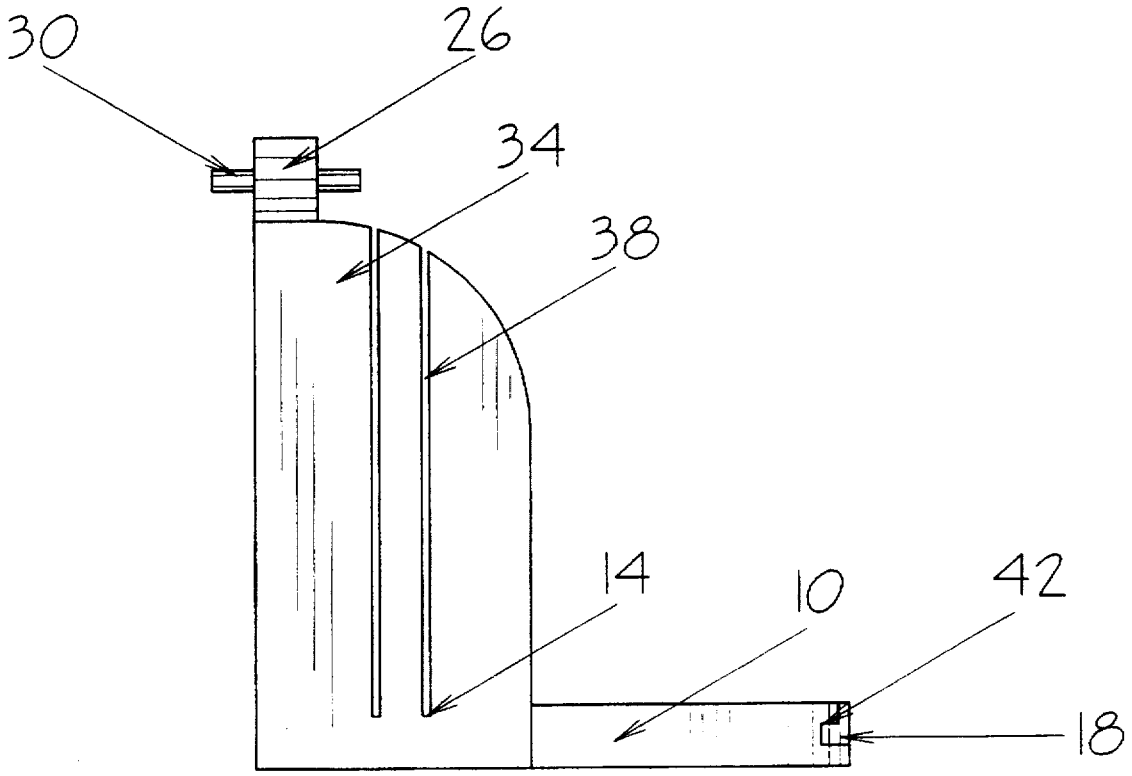
FIG. 3 is a side view showing two guide slots extending from the top of the side enclosures down to the planar base.
Figure 10:
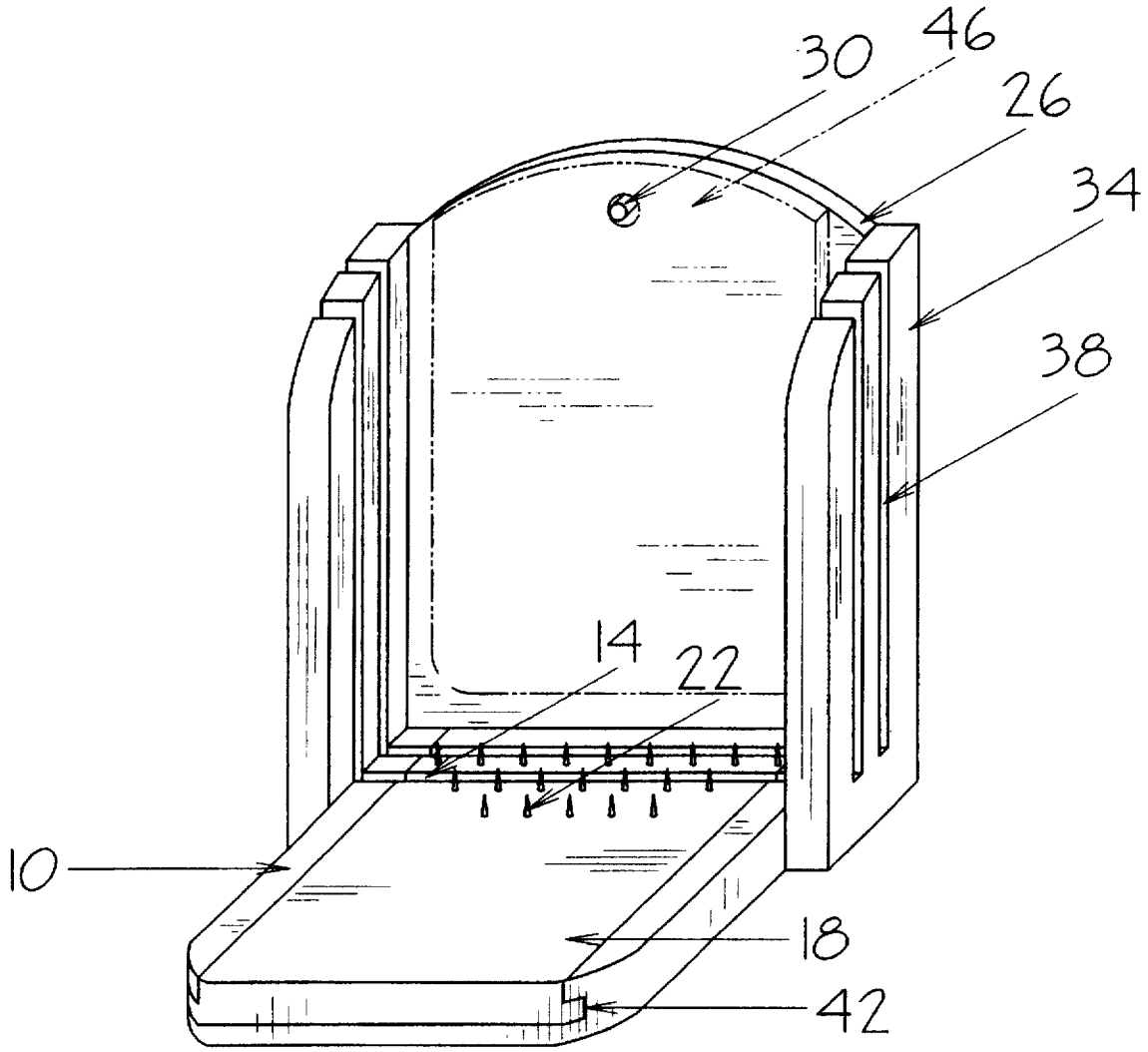
FIG. 10 is a perspective view of the food slicing guide of FIG. 1 with the adjustment plate shown in phantom lines as being supported on the front side of the end enclosure.

A typical embodiment of the slicer of the present invention is illustrated in FIGS. 1 and 10 (perspective view), FIG. 2 (top view), and FIG. 3 (side view). The slicer consists of a planar base 10, having a removable protrusion holder 18 with protrusions 22, side enclosures 34, end enclosure 26, and adjustment plate or plates 46. The device is preferably constructed from hardwood, such as ash, birch, cherry, or other suitable material, such as plastic.

Figure 4:
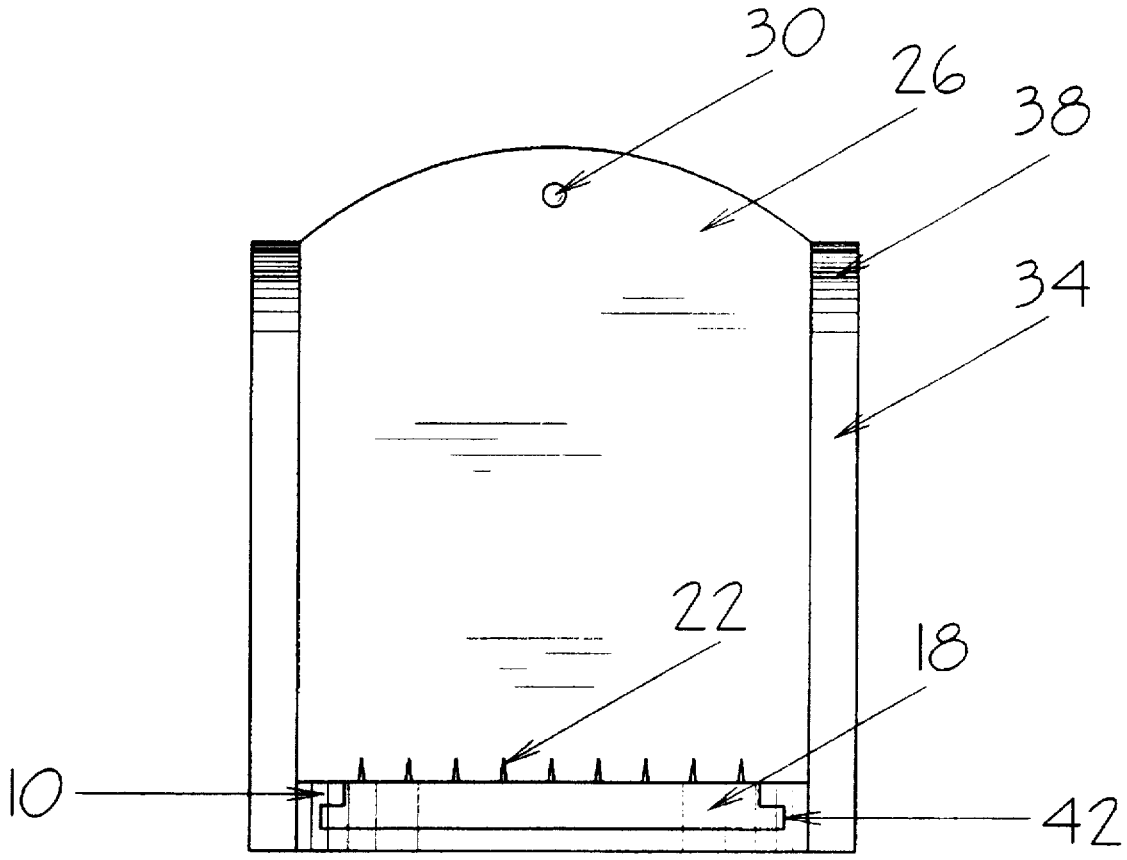
FIG. 4 is a front view with a groove for the removable protrusion holder visible.
Figure 5:
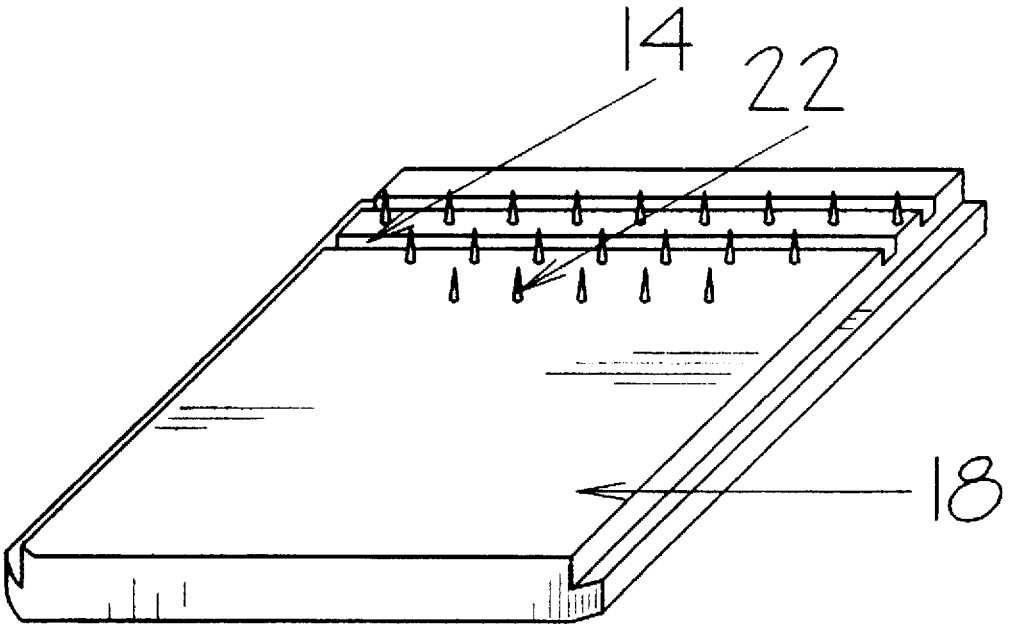
FIG. 5 is a perspective view of the removable protrusion holder.
Figure 6:
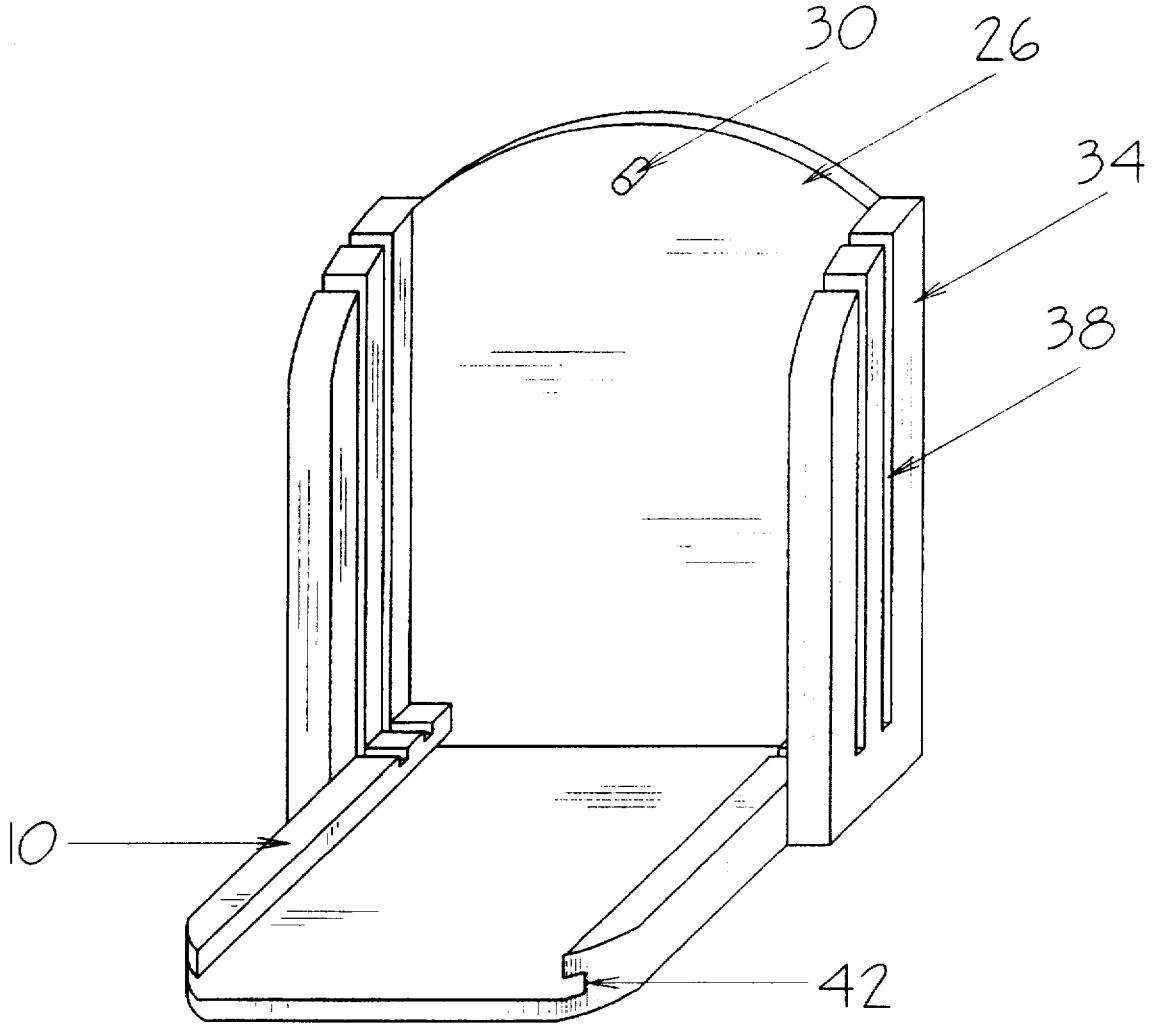
FIG. 6 is a perspective view of the food slicing guide of the present invention showing a planar base with the removable protrusion holder removed from the planar base.
Figure 9:
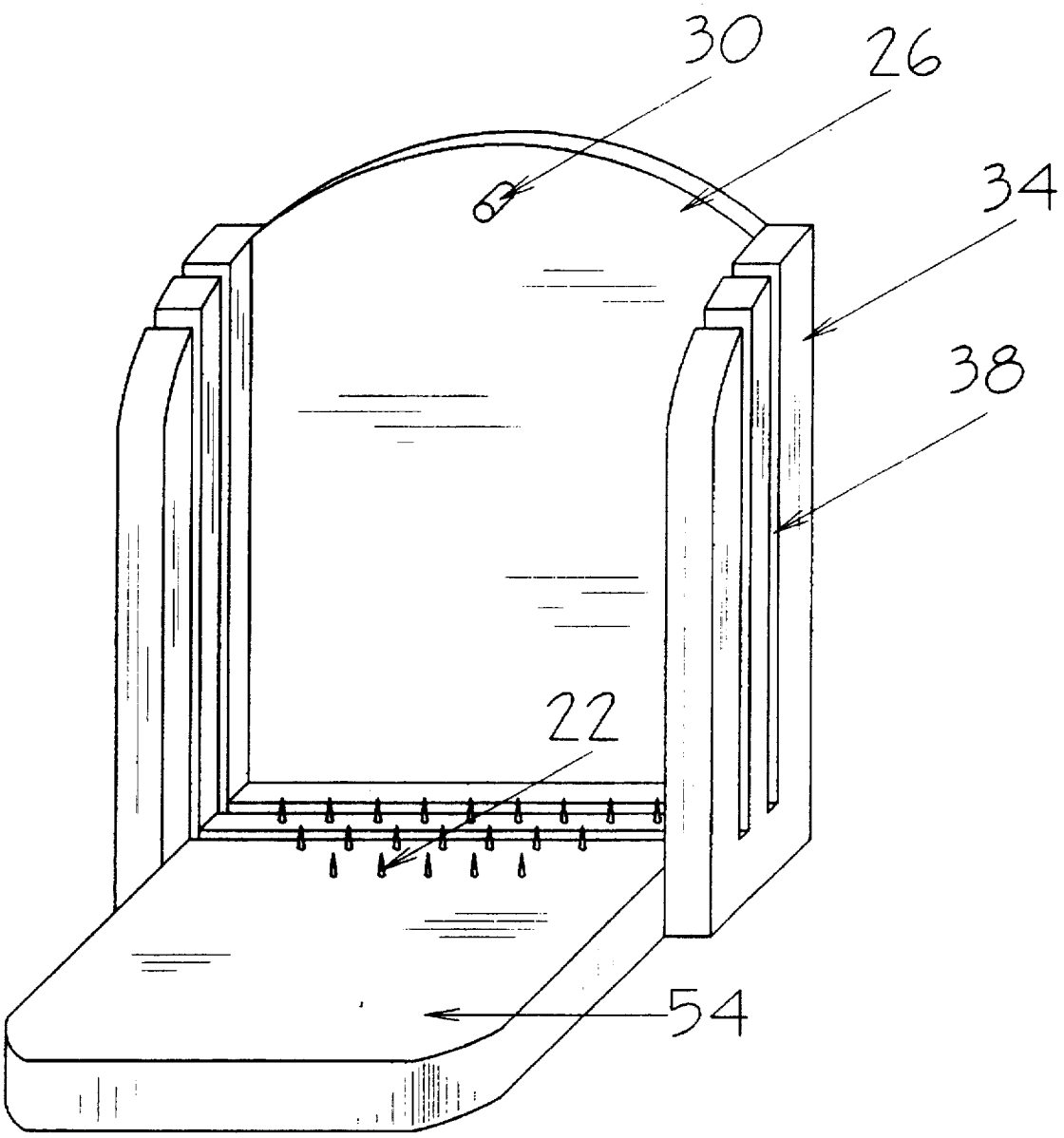
FIG. 9 is a perspective view of the food sliding guide of the present invention showing an alternative construction wherein the planar base also serves as the protrusion holder.

FIG. 5 shows the removable protrusion holder uses protrusions 22 to pierce through the bread and hold it in place while being sliced. FIG. 4 and FIG. 6 show a groove 42 to accept the removable protrusion holder. FIG. 9 shows an alternative construction where the planar base 54 also serves as a protrusion holder. As shown in FIG. 9, the slicer does not need to be constructed with a removable protrusion holder in order for it to fulfill its intended function.

If the device is constructed of wood and does not have a removable protrusion holder, protrusions may consist of small nails or wires extending completely through the planar base. If constructed of wood with a removable protrusion holder, the nails would only be driven through the removable protrusion holder. Devices made of plastic may have protrusions molded into either the planar base or removable protrusion holder, depending on whether a removable protrusion holder was used.

A removable protrusion holder 18 facilitates the cleaning of the plate and cutting platform. When a removable protrusion holder becomes overly abraded or soiled, it may be disposed of and replaced with a new plate.

A planar base 10 with a removable protrusion holder 18 has a groove 42 to accept protrusion holder 18. Groove depth and protrusion holder thickness are such that the protrusion holder top is flush or slightly above the planar base top.

The planar base has an end enclosure 26 and side enclosures 34. One purpose of the end enclosure is to position the bread. The end enclosure has a short rod or dowel 30 extending from its backside; the rod is located on the end enclosure's centerline and toward its top. The rod on the backside of the end enclosure provides an easy way to store adjustment plates, however alternative storage methods, such as bins, may be used.

The hole accepting the rod may be of large enough diameter and made to extend through the end enclosure so that the rod can slide in the hole. Such a hole allows the rod 30 to be pushed out of the way when placing the item to be sliced onto the planar base. Alternatively, the rod can simply be fixed and extend from the backside.

Figure 7:
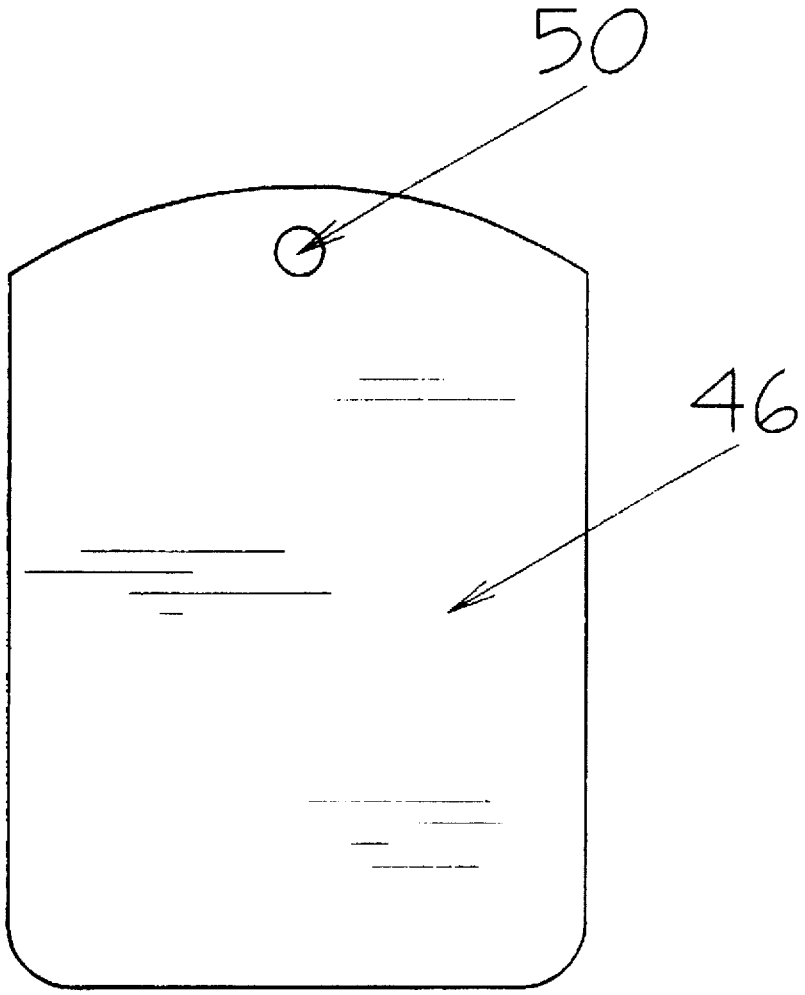
FIG. 7 is a front view of an adjustment plate.
Figure 8:
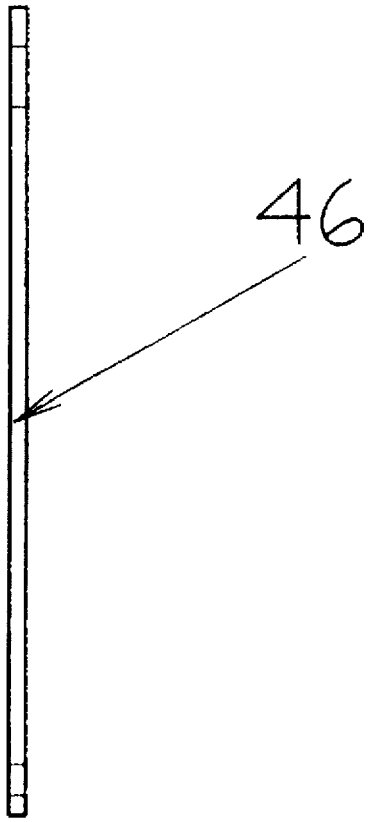
FIG. 8 is a side view of the adjustment plate.

One or more adjustment plates 46 are provided. FIG. 7 and FIG. 8 respectively show front and side views of an adjustment plate. Adjustment plates can be of varying thicknesses. Each plate has a through-hole 50 located near its top and on its centerline. When in use, the plates are hung from the rod 30 if it extends through the end enclosure, or the plate 46 can simply be placed against the end enclosure, held in place by the object being sliced. Alternative methods to hold the adjustment plates in place may also be used.

When an adjustment plate or plates is placed on the front side of the end enclosure, as shown in FIG. 10 it decreases the distance between the front face of the end enclosure and the cutting channel most proximal to it. Adding adjustment plates to the front side of the end enclosure decreases the thickness of the piece of bread being sliced.

The side enclosures each contain a guide slot 38 or slots to guide the cutting tool. The slots start at the top of the side enclosures and extend down to the top of the planar base. The guide slots are positioned so that the distance between the guide slot most proximal to the end enclosure is the same as the distance between the guide slots. The guide slots guide the cutting tool, insuring a cut perpendicular to the planar base.

A cutting channel 14 extends across the planar base 10 and the removable protrusion holder 18. The channel is located so that it is in alignment with the guide slot 38. The channel 14 facilitates the passing of a cutting instrument through the lower side of the item being sliced.

If the slicing device is constructed so that the top of the removable protrusion holder 18 is slightly above the planar base 10, then the cutting channel 14 in the planar base 10 is not necessary and may be eliminated. In such devices the cutting channel 14 would only need extend across the removable protrusion holder 18.

If the slicing device is constructed so that the planar base 54 also serves as a protrusion holder, then the cutting channel 14 extends across width of the planar base 10, from one guide slot 38 to another.

The manner of using the slicing device is to first decide the desired thickness of the piece being sliced. The slicing device provides a means to vary the distance between the guide slot most proximal to the end enclosure and the end enclosure itself. Inserting an adjustment plate 46 between the end enclosure 26 and most proximal guide slot decreases the thickness of the sliced pieces. One or more adjustment plates may be used. The user then places an item, such as a loaf of bread, on the planar base, pushing down so that the protrusions pierce the underside of the bread. The end of the loaf should abut the end enclosure or adjustment plate(s). The loaf will hold the adjustment plate in place, if in use.

The user then inserts a cutting tool, such as a knife, through the guide slot 38 most proximal to the end enclosure. The knife is positioned over the item being sliced, and through the corresponding slot in the opposite side enclosure. The knife is then drawn back and forth across the item until it meets the bottom of the cutting channel in the protrusion holder or planar base.

If adjustment plates were used, and another slice of the same thickness desired, the user removes the cut slice, repositions the bread, and repeats the above process.

If the user desires to replace or clean the protrusion holder, they simply slide it out of its groove. The protrusion plate can then be cleaned, or replaced with a new one if the original has been damaged.

What is claimed and desired to be secured by Letters of Patent is as follows:

1. A food cutting apparatus comprising:

a cutting platform having a cutting surface for supporting an item being cut;

guide means for guiding a cutting edge of a knife through the item being cut, said guide means being attached at an angle relative to a surface of said cutting platform;

gripping means for holding the item being cut in place on the cutting surface; and positioning means for positioning the item being cut with respect to the guide means, said positioning means including an end enclosure mounted on said cutting platform adjacent said guide means, said positioning means further including at least one adjustment plate removably mounted to the end enclosure to space said item being cut a desired distance from the end enclosure and in a desired location relative to said guide means;

wherein said adjustment plate includes a hole therein, and said end enclosure includes a rod extending therefrom, and said rod of said adjustment plate extends through the hole of the at least one adjustment plate to removably mount the adjustment plate to said end enclosure.

2. The apparatus of claim 1 wherein said cutting platform comprises a facilitating means for ensuring that the item being cut is completely cut by said cutting edge.

3. The apparatus of claim 2 wherein said facilitating means comprises channels in the cutting platform.

4. The apparatus of claim 1 wherein a portion of said cutting surface is removable from the rest of the cutting platform.

5. The apparatus of claim 1 wherein said gripping means comprises protrusions on the cutting surface.

6. The apparatus of claim 1 wherein said positioning means further comprises a storing means for storing said at least one adjustment plate when said adjustment plate is not being utilized.

* * * * *